US007325400B2

(12) United States Patent
Cunningham et al.

(10) Patent No.: US 7,325,400 B2
(45) Date of Patent: Feb. 5, 2008

(54) RANKINE CYCLE AND STEAM POWER PLANT UTILIZING THE SAME

(75) Inventors: Carla I. Cunningham, Orlando, FL (US); Michael S. Briesch, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 686 days.

(21) Appl. No.: 10/754,194

(22) Filed: Jan. 9, 2004

(65) Prior Publication Data

US 2005/0150227 A1 Jul. 14, 2005

(51) Int. Cl.
*F01K 13/00* (2006.01)

(52) U.S. Cl. ..... 60/645; 60/670

(58) Field of Classification Search ..... 60/651, 60/671, 645, 670
See application file for complete search history.

(56) References Cited

U.S. PATENT DOCUMENTS

| | | | | |
|---|---|---|---|---|
| 3,314,236 | A | 4/1967 | Zanoni | |
| 4,178,989 | A * | 12/1979 | Takeshita et al. | 165/62 |
| 4,297,848 | A | 11/1981 | Silvestri, Jr. | |
| 5,027,602 | A * | 7/1991 | Glen et al. | 60/651 |
| 5,052,175 | A | 10/1991 | Brueckner et al. | |
| 5,216,899 | A * | 6/1993 | Fabris | 62/324.6 |
| 5,437,157 | A * | 8/1995 | Bronicki | 60/655 |
| 5,850,739 | A | 12/1998 | Masnoi | |
| 6,003,317 | A | 12/1999 | Neubert | |
| 6,234,400 | B1 * | 5/2001 | Guyer | 237/12.1 |
| 6,413,065 | B1 | 7/2002 | Dass | |
| 6,422,017 | B1 | 7/2002 | Bassily | |
| 6,457,950 | B1 | 10/2002 | Cooper et al. | |

FOREIGN PATENT DOCUMENTS

| | | | |
|---|---|---|---|
| DE | 2 242 302 | | 3/1974 |
| DE | 33 27 838 | A1 | 12/1983 |
| DE | 35 31 469 | A1 | 3/1987 |
| DE | 36 16 797 | A1 | 11/1987 |
| DE | 195 24 216 | A1 | 1/1997 |
| FR | 974 116 | | 2/1951 |
| GB | 885643 | | 12/1961 |
| GB | 2 166 529 | A | 5/1986 |
| JP | 2002-303105 | * | 10/2002 |

* cited by examiner

*Primary Examiner*—Hoang Nguyen

(57) ABSTRACT

A steam power plant (100) implementing an improved Rankine cycle (55) wherein steam is injected (82, 96) directly into the energy addition portion of the plant, and the resulting two-phase flow is pressurized by multiphase pumps (88, 98). By relying more heavily on pump pressurization than on a temperature difference for energy injection, plant efficiency is improved over prior art designs since energy injection by pump pressurization results in less irreversibility than energy injection by temperature difference. Direct steam injection and multiphase pumping may be used to bypass the condenser (20), to replace any one or all of the feedwater heaters (24, 32, 34), and/or to provide additional high-pressure energy addition.

21 Claims, 7 Drawing Sheets

RANKINE CYCLE AND STEAM POWER PLANT UTILIZING THE SAME

FIELD OF THE INVENTION

This invention relates generally to the field of vapor cycles and more particularly to steam power plants operating on a Rankine cycle.

BACKGROUND OF THE INVENTION

Basic elements of a conventional steam power plant 10 are illustrated in schematic form in FIG. 1. A boiler 12 burns a combustible fuel to provide heat energy to convert feedwater into saturated or superheated steam for delivery to a high-pressure turbine 14. The steam is expanded through the turbine 14 to turn a shaft that powers an electrical generator (not shown). The steam is then directed in sequence through an intermediate pressure turbine 16 and a low-pressure turbine 18 where additional shaft energy is extracted. The spent steam leaving the low-pressure turbine 18 is converted back to water in condenser 20. A condensate pump 22 delivers water from the condenser 20 to a low-pressure feedwater heater 24. The feedwater heater 24 is a heat exchanger that adds energy to the water as a result of a temperature difference between the water and steam supplied through a low-pressure steam extraction line 26 from the low-pressure turbine 18. The heated water is collected in a feedwater tank 28 which is also provided with an intermediate-pressure steam extraction connection 29. From the feedwater tank 28, the water is delivered by a feedwater pump 30 through an intermediate pressure feedwater heater 32 and high-pressure feedwater heater 34, where additional energy is supplied via the temperature difference between the water and steam supplied through intermediate pressure steam extraction line 36 and high-pressure steam extraction line 38 respectively. The heated feedwater is then delivered back to the boiler 12 where the cycle is repeated. Plant 10 may include many other components, systems and subsystems that are not illustrated in FIG. 1 but that are well known in the art. Other known steam power plant designs may utilize fewer or additional pressure stages for both energy extraction and feedwater heating.

The power plant 10 of FIG. 1 is a heat engine with a vapor cycle commonly referred to as a Rankine cycle. An ideal Rankine cycle consists of four processes: isentropic expansion through an expansion engine such as a turbine, piston, etc.; isobaric heat rejection through a condenser; isentropic compression through a pump; and isobaric heat supply through a boiler. FIG. 2 is a typical Ts diagram illustrating the relationship of entropy and temperature for a prior art Rankine cycle 39 such as may be implemented in prior art power plant 10. The dashed line represents the vapor dome underneath which the working fluid (water for most commercial power plants) will exist in both the liquid and vapor states simultaneously. Saturated or superheated steam enters a turbine at state 40, where it expands to the exit pressure at state 42. This expansion is not completely isentropic due to the expected inefficiencies in the turbine design. The steam is condensed at constant pressure and temperature to a saturated liquid at state 44. The saturated liquid then flows through condensate pump that increases the pressure to state 46. The pressurized water is heated through the low-pressure feedwater heater 24 to state 48 and further pressurized to boiler pressure by feedwater pump 30 to state 50. The water is then further heated through intermediate pressure feedwater heater 32 and high-pressure feedwater heater 34 to states 52, 54 respectively. The water is then heated to saturation temperature, boiled and typically superheated back to state 40 in boiler 12.

The rising cost of fuel and the demand for lower emissions provide a continuing need for improvements in the efficiency of operation of steam power plants.

DETAILED DESCRIPTION OF THE INVENTION

Figure 1:
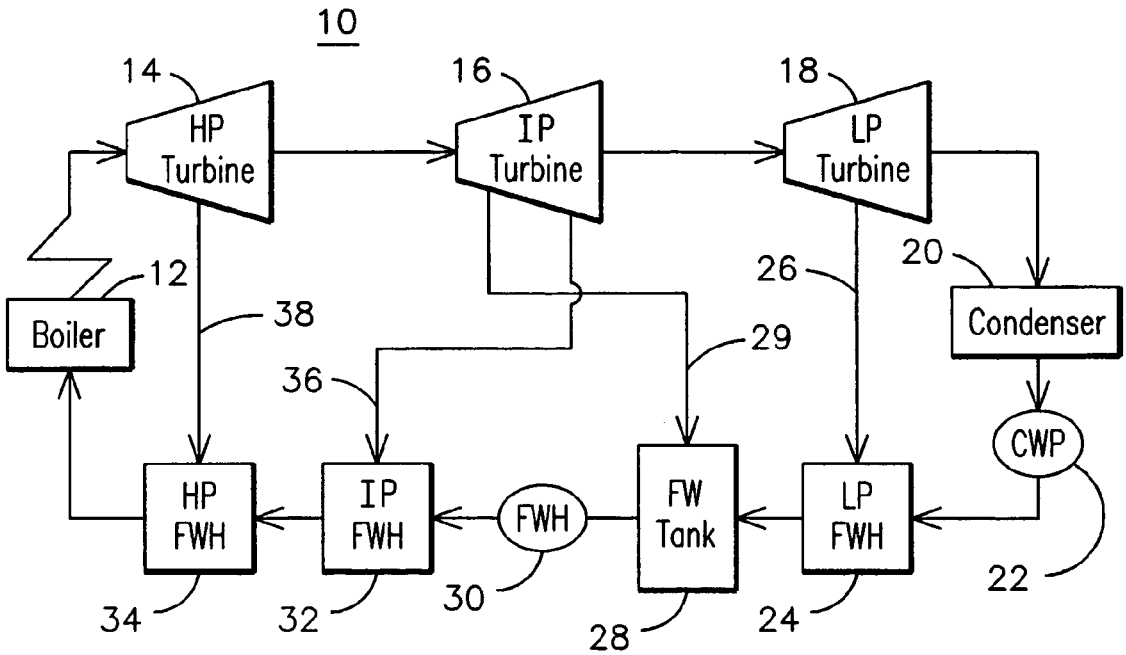
FIG. 1 PRIOR ART
FIG. 1 is a schematic illustration of a prior art steam power plant.

The energy addition upstream of the boiler 12 in prior art steam power plant 10 of FIG. 1 occurs primarily through the temperature difference (?T) generated within the feedwater heaters 24, 32, 34, with a relatively smaller portion of the energy being supplied by condensate pump 22 and feedwater pump 30. It is well known that energy addition via a temperature difference will increase the enthalpy of a system and will add irreversibility to the cycle. Irreversibility is understood to be energy addition that is not recoverable in the energy extraction portion of the cycle. Irreversibility reduces the operating efficiency of a power plant.

The present inventors have innovatively recognized that an improved steam power plant design may be achieved by replacing or augmenting one or more of the feedwater heaters used in prior art designs with direct steam injection into the condensate/feedwater stream, and further by pressurizing the resulting two-phase steam/water flow by using a multiphase pump. The multiphase pump will be operating in a region of the Ts diagram wherein the pressure increase is very near to being isentropic, i.e. in a region of low steam quality (high liquid content) under the steam dome. As a result, the energy addition to the cycle upstream of the boiler is achieved with a reduced amount of irreversibility than in prior art designs, thus improving the overall efficiency of the cycle.

Figure 3:
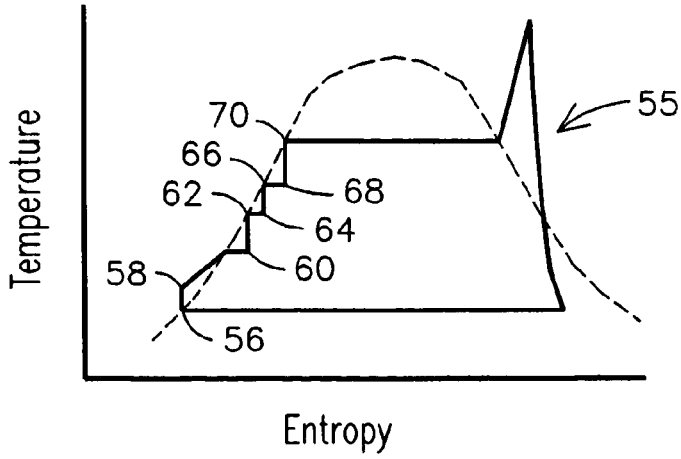
FIG. 3 is a Ts diagram for an improved Rankine cycle steam power plant.

FIG. 3 illustrates a Ts diagram for a modified Rankine cycle 55 that can be implemented in a steam power plant wherein the feedwater heaters and single-phase feedwater pump have been replaced by direct steam injection and multi-phase pumping. The condensate water exits a condenser at state 56 and is pressurized to state 58 by a single-phase condensate pump. Low-pressure steam is injected into the water and increases the energy level to create a two-phase steam/water mixture under the dome of the Ts diagram at state 60. A multi-phase pump is then used to increase the pressure of the steam/water mixture, preferably to at least the saturated condition at state 62. Intermediate pressure steam is then injected to return the water to a two-phase condition at state 64, and additional energy is added with a multi-phase pump to further increase the pressure to state 66. A high-pressure steam injection and further multi-phase pump pressure further increase the energy of the working fluid to states 68, 70 respectively.

The use of direct steam injection in lieu of a feedwater heater will result in two-phase steam/liquid flow in a portion of the condensate/feedwater system where only liquid had been present in prior art designs. A multi-phase pump is needed to provide the necessary pressure increase in such a two-phase fluid. Although the present inventors are unaware of multiphase pumps designed specifically for the particular steam/water flow conditions developed in a steam power plant, it is believed that the design and production of such pumps are well within the capability of existing technology, since multiphase pumps have been commercialized for use in the petroleum industry. Accordingly, the exemplary embodiments that are described herein assume the availability of multiphase pumps in the size (developed head and flow rate) required for conventional steam plants.

Figure 2:
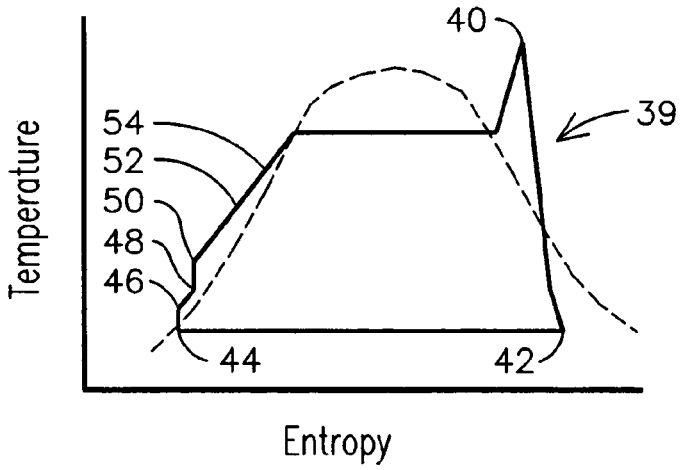
FIG. 2 PRIOR ART
FIG. 2 is a Ts diagram for a prior art Rankine cycle steam power plant.
Figure 4:
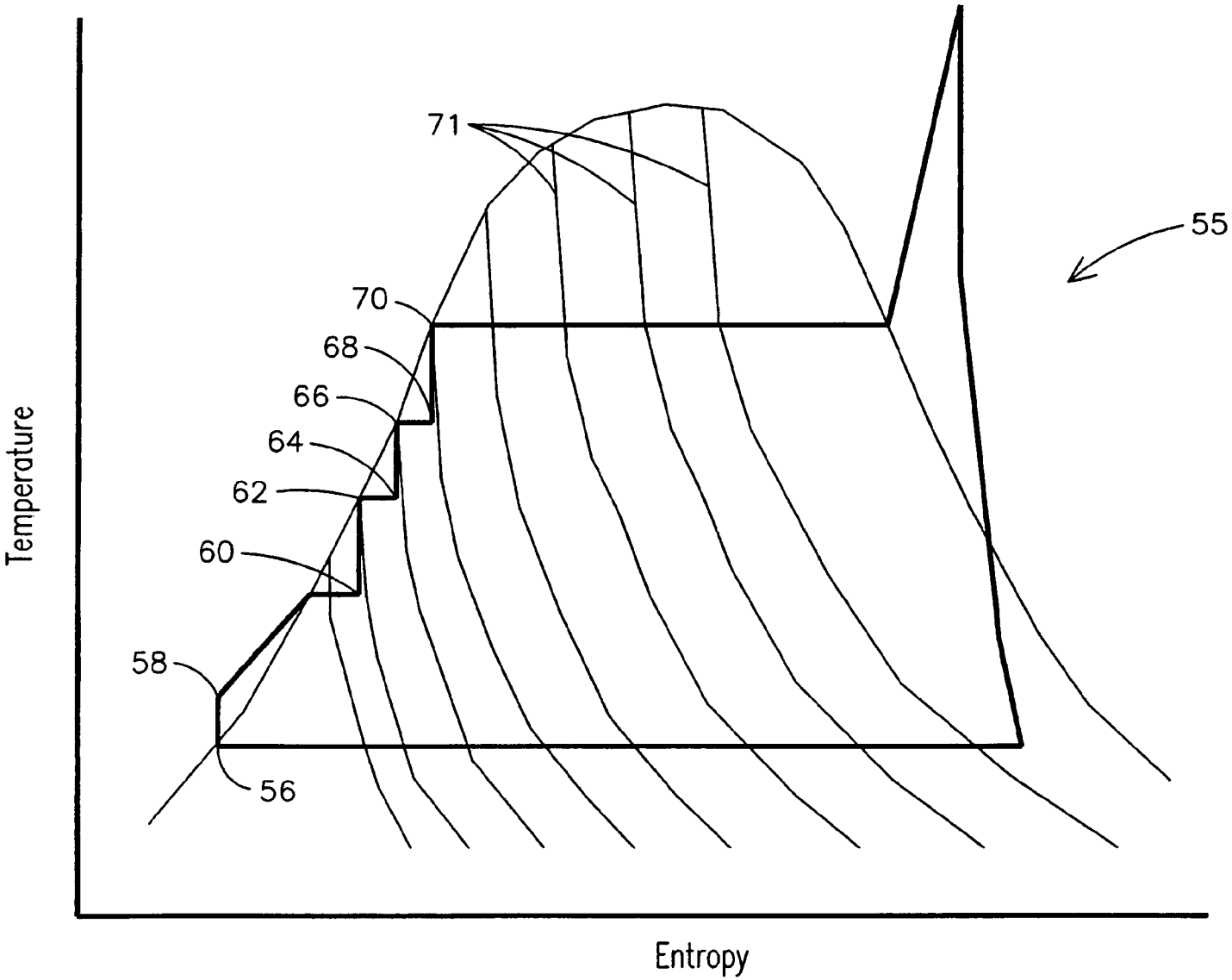
FIG. 4 is the Ts diagram of FIG. 4 and including lines of constant enthalpy.

The energy additions (pressure increases) generated by the multiphase pumps between states 60 and 62, and between states 64 and 66, and between states 68 and 70 shown in FIG. 3 are accomplished with little enthalpy increase and with the addition of little irreversibility. This may be more clearly appreciated by viewing FIG. 4, which illustrates the modified Rankine cycle 55 of FIG. 3 together with lines of constant enthalpy 71. Notice that in the region of low quality steam (typically 0-20% steam), the lines of constant enthalpy are close to being vertical, and the pressure increase accomplished by multiphase pumping in this region minimizes the addition of irreversibility. The pre-boiler energy additions produced by multi-phase pumping under the steam dome generate less irreversibility than do the energy additions produced by ?T across the feedwater heaters outside the steam dome. Accordingly, a steam power plant utilizing the Rankine cycle 55 of FIG. 4 will exhibit improved efficiency when compared to a prior art plant utilizing the prior art Rankine cycle 39 of FIG. 2.

To demonstrate the potential for improved steam plant efficiency through the utilization of the present invention, five embodiments of steam power plants are described below, and their respective efficiencies are compared to a prior art steam plant similar to plant 10 of FIG. 1. The various embodiments each utilize direct steam injection and multi-phase pumping in a different configuration. It is envisioned that other embodiments or combinations of the described embodiments may be used. The embodiments described herein are believed to be representative of the present invention and to be inclusive of the best mode of the invention as it is currently contemplated. A software program proprietary to the assignee of the present invention was used to calculate the thermodynamic efficiency of each embodiment, however, manual calculations or any appropriate commercially available mass and energy balance software system (e.g. GateCycle™ software) may be used. Note that the multiphase pumps included in the respective designs were modeled as having an isentropic efficiency of 75% based upon the inventors' general understanding of the state of the art, although pump design experts were not consulted in this regard. Actual pump efficiencies of 75-85% are expected. FIG. 1 is a simplified representation of the base plant that was modeled. For example, the modeled plant utilizes four low-pressure feedwater heaters with associated drain coolers, whereas all of these components are represented in FIG. 1 by a single LP feedwater heater 24. The modeled base plant also includes two high-pressure feedwater heaters and associated drain coolers, and it includes drain coolers associated with the intermediate feedwater heater.

Table 1 describes the modeled base plant design conditions.

TABLE 1

BASE PLANT DESIGN CONDITIONS

| | |
|---|---|
| Net Plant Output | 750 MW |
| Steam into HPT | 4,707,000 lb/hr<br>3,690 psia<br>1050° F. |
| Reheat Temperature | 1050° F. |
| LPT Back Pressure | 1.5" Hg |
| 3 LP FWHs | Extractions at 35, 11, 4 psia |
| 2 IP FWHs | Extractions at 355, 85 psia |
| 1 FW Tank | Extraction at 190 psia |
| 2 HP FWHs | Extractions at 1225, 870 psia |

Figure 5:
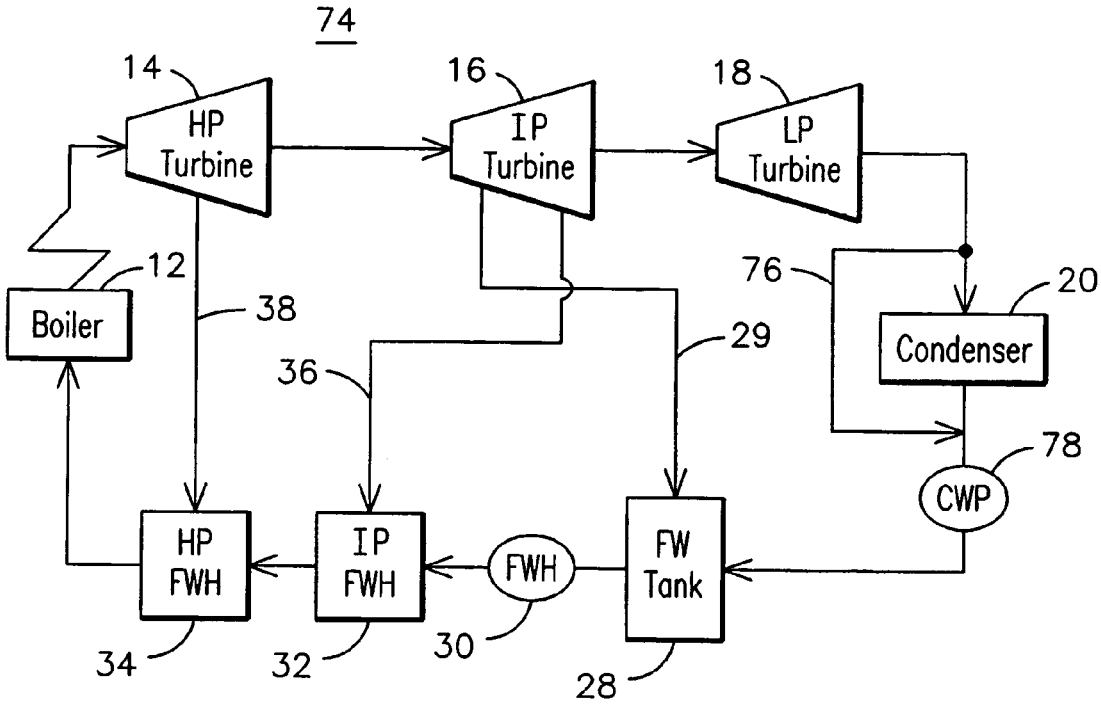
FIG. 5 is a schematic illustration of a steam power plant wherein low-pressure feedwater heaters are replaced by steam injection and multi-phase pumping.

A first embodiment is illustrated in FIG. 5 wherein a steam power plant 74 implementing an improved Rankine cycle is provided with a bypass 76 of condenser 20 in order to eliminate the need for low-pressure feedwater heaters. Note that similar components used in various embodiments are numbered consistently in respective figures. At least some of the steam from the exhaust of the low-pressure turbine 18 is bypassed around condenser 20. The mass flow of the bypass steam may be selected such that the conditions downstream of the condensate pump 78 are the same as they were downstream of the low-pressure feedwater heaters in the prior art plant 10 of FIG. 1. The condensate pump 78 receives a steam/water mixture, thus pump 78 must be a multiphase pump. FIG. 5 is drawn to show that all low-pressure feedwater heaters have been eliminated. Other embodiments may eliminate only one or more of the low-pressure feedwater heaters while retaining at least one low-pressure heater. One may appreciate that when this invention is implemented as a retrofit to an existing steam power plant, the existing low-pressure feedwater heaters may remain in place physically and may be made non-functional as heat exchangers by isolating the steam side of the heaters.

Figure 6:
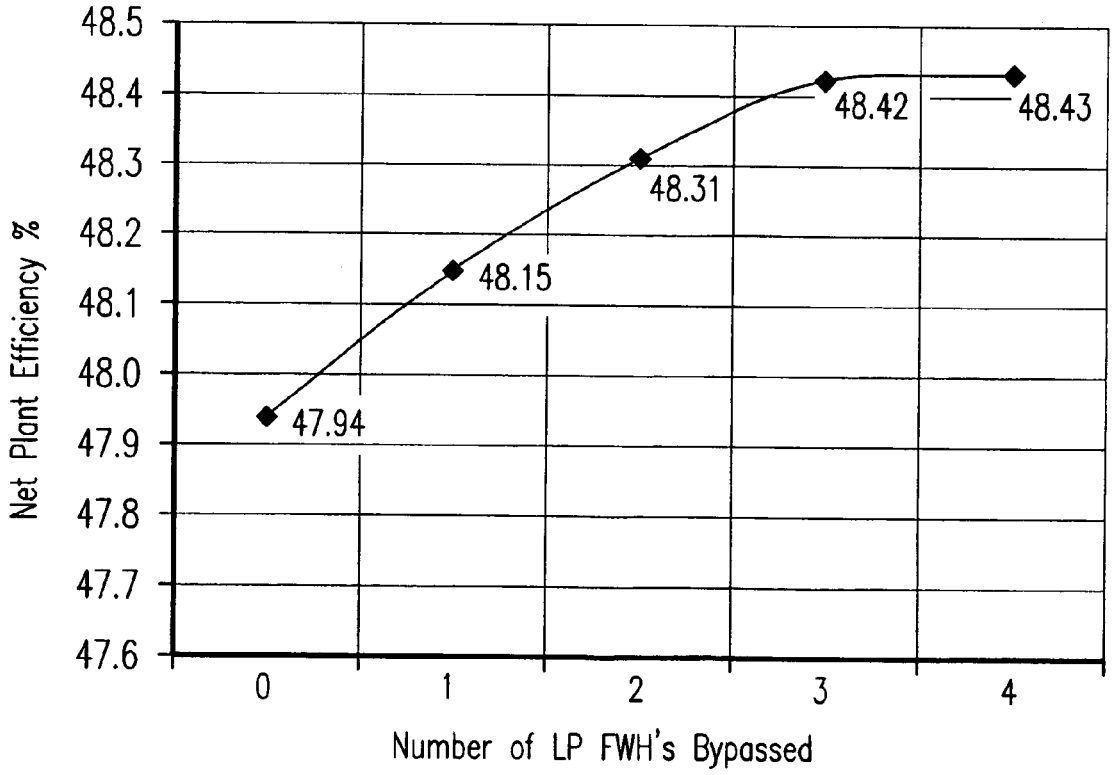
FIG. 6 is a chart of the plant efficiency achieved as low-pressure feedwater heaters are replaced by condenser bypass flow and multiphase pumping.

FIG. 6 shows the net plant efficiency as each of the four low-pressure feedwater heaters of the modeled plant is bypassed, with the bypass steam flow being varied in each example so that the conditions downstream of the replaced feedwater heater(s) is the same as it would be in the prior art plant 10. The maximum efficiency gain of 0.49% occurs with all four low-pressure feedwater heaters being replaced by condenser bypass flow and multiphase pumping.

The bypass 76 functions as a steam extraction/injection connection having an inlet connected to the energy extraction portion of the plant (between the boiler 12 and condenser 20) and having an outlet connected to the energy addition portion of the plant (between the condenser 20 and the high-pressure turbine 14 or more specifically between the condenser 20 and the boiler 12). The bypass 76 directly injects relatively higher energy steam from the energy extraction portion into relatively lower energy water in the energy addition portion to achieve an energy addition without the need for a ?T heat exchanger. Thus the energy addition is accomplished in greater part by pump pressurization and in lesser part by a temperature difference than in the prior art plant 10, thereby reducing the addition of irreversibility.

Figure 7:
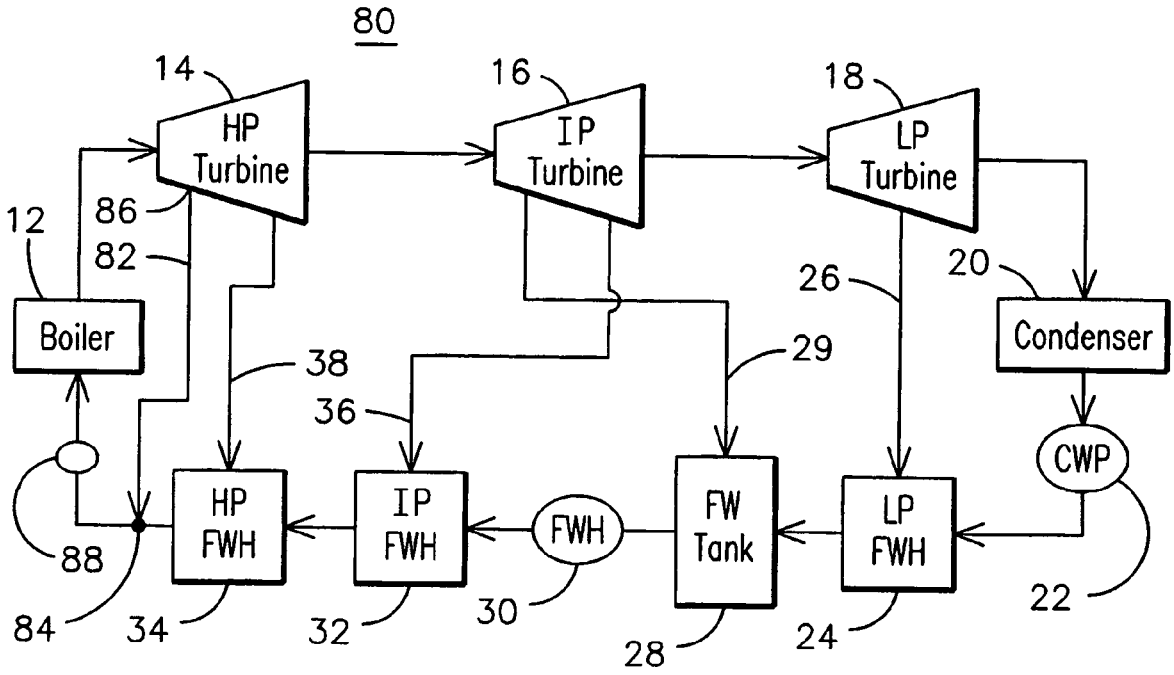
FIG. 7 is a schematic illustration of a steam power plant wherein high-pressure steam injection and multi-phase pumping is provided downstream of the high-pressure feedwater heater.

A second embodiment illustrated in FIG. 7 also has an inlet connected to the energy extraction portion of the plant and an outlet connected to the energy addition portion of the plant. In this embodiment, a steam power plant 80 is provided with a high-pressure steam extraction connection 82 for injecting high-pressure steam into the feedwater system at a point 84 downstream of the high-pressure feedwater heater 34 and upstream of the boiler 12. The high-pressure steam extraction connection inlet 86 draws steam from the high-pressure section of the steam system proximate the high-pressure turbine 14. One may appreciate that the exact point of extraction may vary depending upon the desired supply pressure. FIG. 7 shows the inlet 86 as a steam bleed directly from one of the stages of the high-pressure turbine 14, although it may be appreciated that any other point proximate the high-pressure turbine 14 may be selected for a particular application. The steam injection will create a steam/water mixture downstream of injection point 84, and multiphase pump 88 is used to increase the pressure of the steam/water mixture to the same pressure as that of the base plant prior to the working fluid entering the boiler 12.

Figure 8:
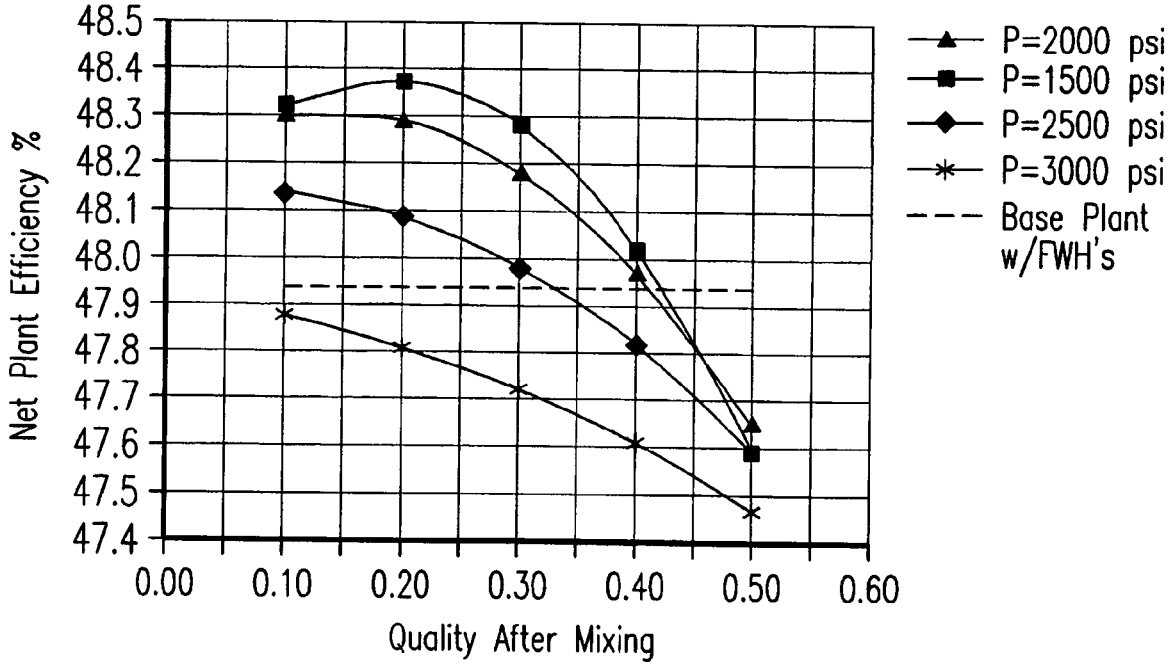
FIG. 8 is a chart of plant efficiency achieved with high pressure feed-water heating and direct high-pressure steam injection. Plant efficiency is shown as a function of steam quality after mixing.

FIG. 8 illustrates the plant efficiency improvement for the modeled steam plant resulting from the inclusion of the high-pressure steam extraction connection 82. The variables illustrated are the steam extraction pressure and the steam quality after mixing, as shown in FIG. 8. The optimum conditions for this example are an extraction pressure of 1,500 psia and a steam quality of 20%, resulting in a net plant efficiency gain of 0.43%.

Figure 9:
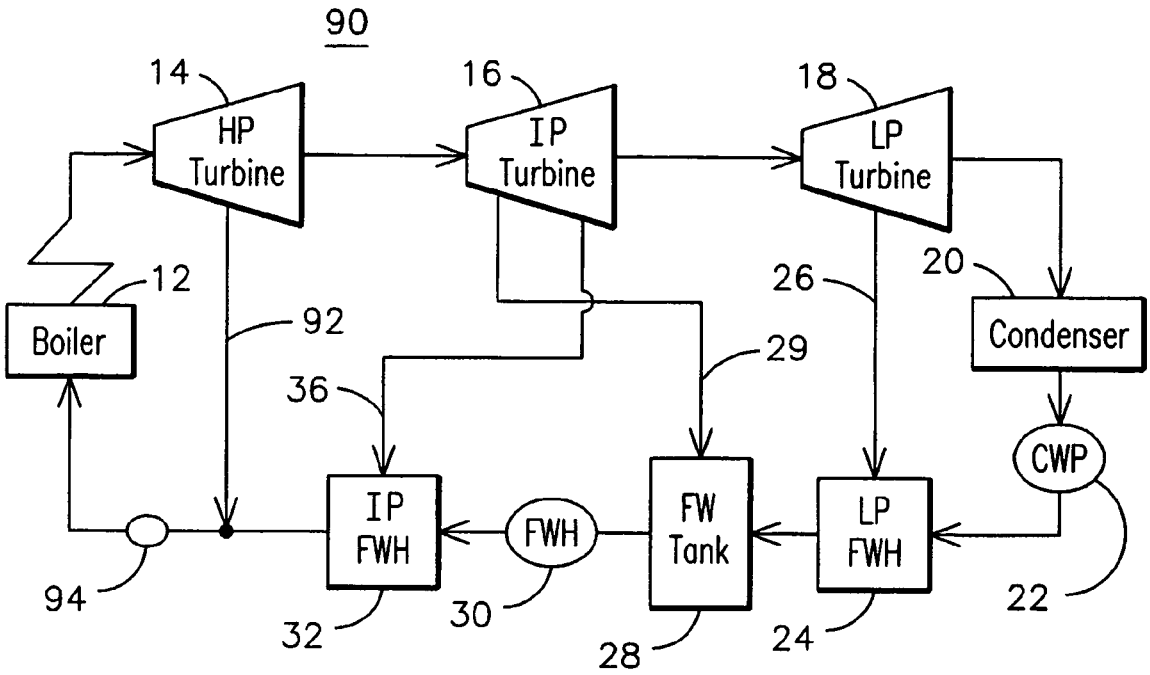
FIG. 9 is a schematic illustration of a steam power plant wherein high-pressure steam injection and multi-phase pumping is provided in lieu of the high-pressure feedwater heaters.
Figure 10:
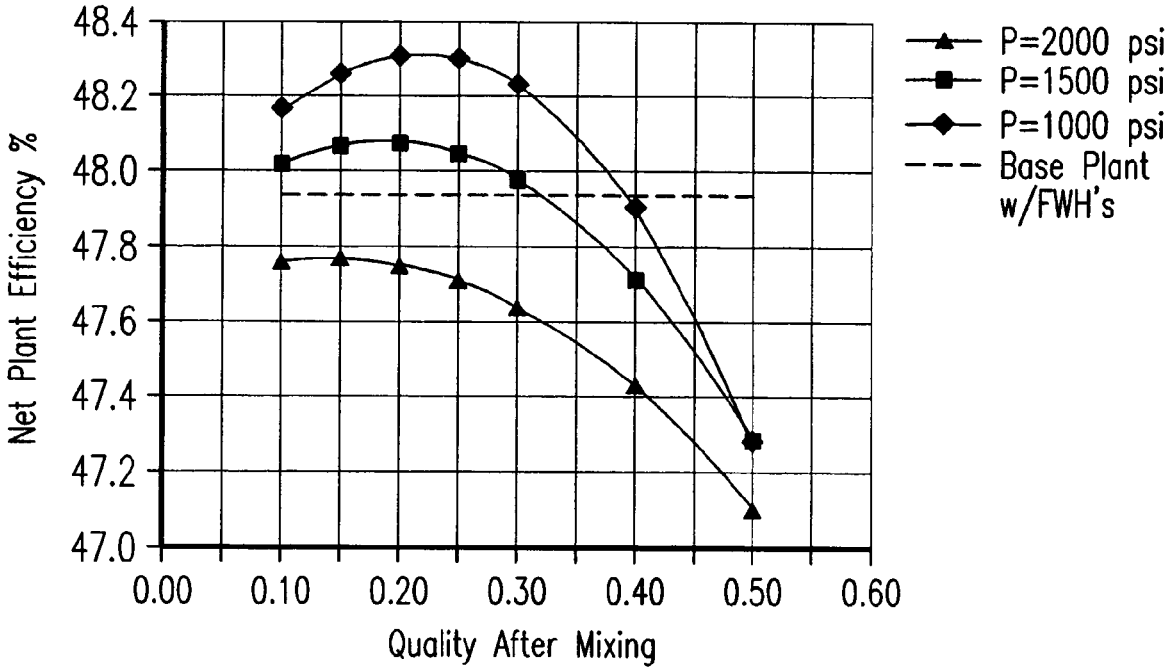
FIG. 10 is a chart of plant efficiency achieved with direct high-pressure steam injection in lieu of HP feedwater heaters as a function of steam quality after mixing.

FIG. 9 illustrates a third embodiment of a steam power plant 90 wherein all high pressure feedwater heaters have been replaced by a high pressure steam injection connection 92 and an associated downstream multiphase pump 94. Here again the variables are the steam extraction pressure and the steam quality after mixing, as shown in FIG. 10. The optimum conditions for this embodiment are an extraction pressure of 1,000 psia and a steam quality after mixing of 20%, resulting in a plant efficiency gain of 0.37%. At these conditions the enthalpy into the boiler 12 is larger than in the modeled base plant, thereby requiring less heat addition in the boiler 12. This results in an increase in plant efficiency even after subtracting the added power load of the multiphase pump 94.

Figure 11:
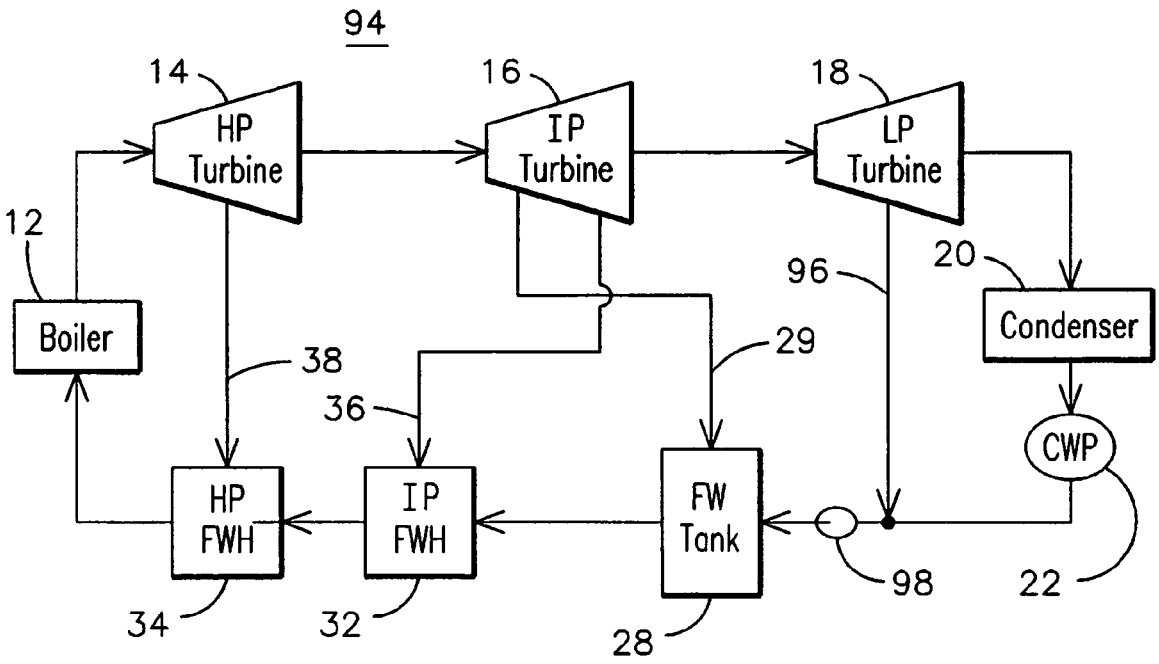
FIG. 11 is a schematic illustration of a steam power plant wherein low-pressure steam injection and multi-phase pumping is provided in lieu of the low-pressure feedwater heaters.

FIG. 11 illustrates a fourth embodiment of a steam power plant 94 wherein all low-pressure feedwater heaters have been replaced by a low-pressure steam injection connection 96 and an associated downstream multiphase pump 98. This embodiment was modeled as having four stages of multiphase pumping corresponding to the four stages of low-pressure feedwater heating in the modeled base plant. The steam extractions were modeled as being taken at the same steam turbine pressure levels and the flows were set to achieve saturated liquid state after mixing and pumping. This extraction flow requirement results in a water/steam mixture into the pumps, hence the need for multiphase pumping. This design results in a higher enthalpy out of the last pump 98 and into the feedwater tank 28, thus requiring a smaller steam extraction flow 29 into the tank 28. This leaves a higher steam flow doing work through the steam turbines. This additional work more than offsets the auxiliary loads required to operate the multiphase pumps 98.

Figure 12:
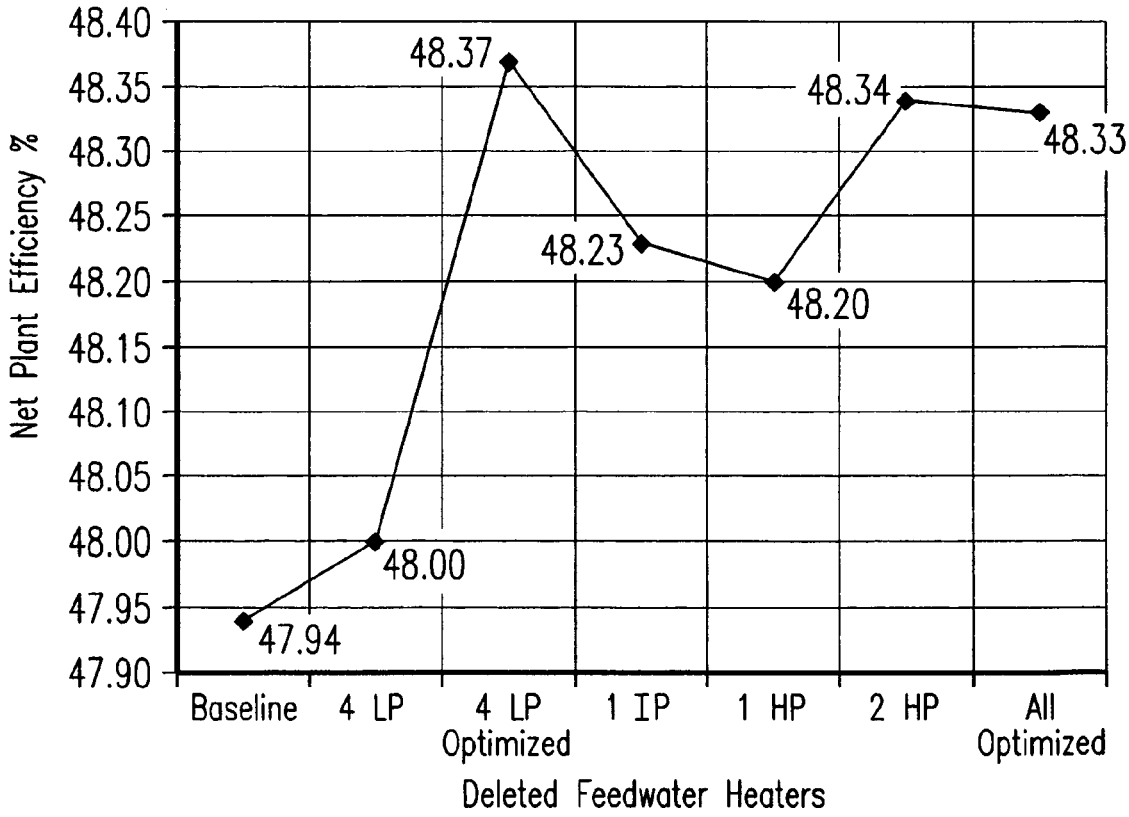
FIG. 12 is a chart of plant efficiency achieved by the use of direct steam injection in lieu of feedwater heaters.

FIG. 12 shows the plant efficiencies for when various feedwater heaters are replaced by direct steam injection and multiphase pumping. The baseline plant efficiency is also shown for comparison. Efficiencies are illustrated for the following options: replacing all four low-pressure feedwater heaters and utilizing the steam extraction flow of the base design; replacing all four low-pressure feedwater heaters and optimizing the extraction flow rate so that a saturated liquid state is achieved after mixing and pumping; replacing the one intermediate-pressure feedwater heater; replacing one high-pressure feedwater heater; replacing both high-pressure feedwater heaters; and replacing all feedwater heaters. The maximum plant efficiency gain in these examples is 0.43% for the case of the optimized replacement of all four of the low-pressure feedwater heaters.

Figure 13:
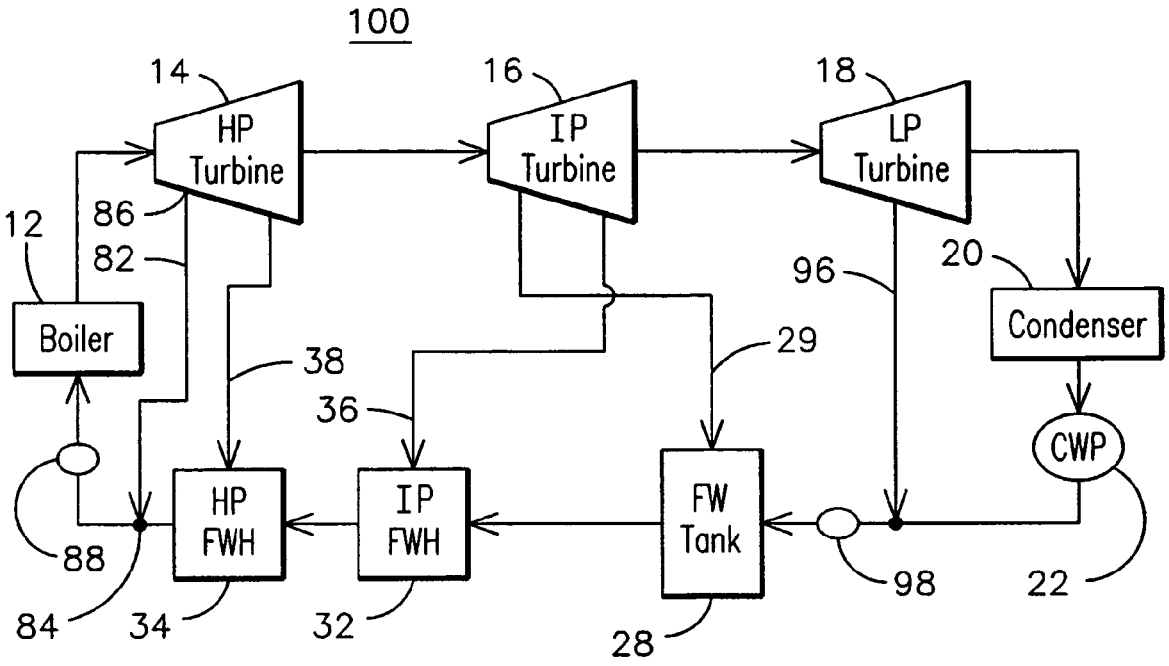
FIG. 13 is a schematic illustration of a steam power plant wherein low-pressure and high-pressure steam injection and multi-phase pumping is provided.

A fifth embodiment is illustrated in FIG. 13 wherein a steam power plant 100 is provided with a high-pressure steam injection connection 82 and multiphase pump 88, and wherein all low-pressure feedwater heaters are replaced by a low-pressure steam injection 96 and multiphase pump 98. When modeled to have optimized flow for all four stages of low pressure injection, this embodiment provides a net plant efficiency improvement of 0.85%.

While various embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A Rankine cycle process implemented in a steam power plant comprising an energy addition portion where a working fluid comprises water in a liquid state and an energy extraction portion comprising the water in a vapor state, the Rankine cycle process comprising:

directing a portion of the water in the vapor state from the energy extraction portion into the liquid water in the energy addition portion to create a two-phase state of the working fluid in the energy addition portion; and pressurizing the working fluid in the energy addition portion when it is in the two-phase state.

2. The Rankine cycle of claim 1, further comprising pressurizing the two-phase working fluid at least to a saturated condition.

3. The Rankine cycle of claim 2, further comprising:

adding energy to the working fluid after it has reached the saturated condition to return the working fluid to a two-phase state; and then further pressurizing the working fluid in the two-phase state.

4. The Rankine cycle of claim 1, further comprising adding energy to the working fluid to bring the working fluid to a predetermined two-phase quality state after the step of pressurizing.

5. The Rankine cycle at claim 4, wherein the step of adding energy comprises mixing with the working fluid an additional quantity of the working fluid that is in a vapor state directed from the energy extraction portion.

6. The Ranking cycle of claim 4, further comprising further pressurizing the two-phase working fluid after the step of adding energy.

7. The Ranking cycle of claim 6, wherein the step of further pressurizing comprises pressurizing the two-phase working fluid at least to a saturated state.

8. A steam power plant comprising a steam extraction connection having an inlet connected to an energy extraction portion of the plant for receiving steam and having an outlet connected to an enemy addition portion of the plant for injecting the steam into a condensate/feedwater flow;

further comprising a multiphase pump for receiving and increasing pressure of a two-phase steam/liquid water flow downstream of the steam extraction connection outlet.

9. The steam power plant of claim 8, wherein a size of extraction and a capacity of the multiphase pump are selected so that a pressure increase generated by the pump is sufficient to produce saturated water at an outlet of the pump.

10. The steam power plant of claim 8, wherein the steam extraction connection bypasses a condenser of the plant.

11. The steam power plant of claim 8, wherein the steam extraction inlet is connected downstream of a low-pressure turbine and the steam extraction connection outlet is connected upstream of a low-pressure feedwater heater.

12. The steam power plant of claim 8, wherein the steam extraction connection inlet is connected proximate a high-pressure turbine and the steam extraction connection outlet is connected downstream of a high-pressure feedwater heater.

13. The steam power plant of claim 8, wherein the steam extraction inlet is connected proximate a high-pressure turbine and the steam extraction outlet is connected downstream of an intermediate pressure feedwater heater.

14. The steam power plant of claim 8, wherein the steam extraction inlet is connected proximate a low-pressure turbine and the steam extraction outlet is connected upstream of one of an intermediate pressure feedwater heater and a high-pressure feedwater heater.

15. The steam power plant of claim 8, further comprising:

a first steam extraction connection having an inlet connected proximate a high-pressure turbine and an outlet connected downstream of a high-pressure feedwater heater; and a second steam extraction connection having an inlet connected proximate a low-pressure turbine and an outlet connected upstream of one of an intermediate pressure feedwater heater and a high-pressure feedwater heater.

16. A method of modifying a steam power plant comprising:

adding a steam injection connection having an inlet connected to an energy extraction portion of the plant and having an outlet connected to an energy addition portion of the plant for injecting relatively higher energy steam from the energy extraction portion into relatively lower enemy water in the enemy addition portion; and adding a multi-phase pump downstream of the steam injection connection outlet for receiving and increasing pressure in a multi-phase flow of steam and water produced by the steam injection.

17. The method of claim 16, further comprising adding the steam injection connection to bypass a condenser of the plant.

18. The method of claim 16, further comprising:

connecting the steam injection connection inlet proximate a high-pressure turbine; and connecting the steam injection connection outlet downstream of a feedwater heater.

19. The method of claim 16, further comprising:

connecting the steam injection connection inlet proximate a high-pressure turbine; and connecting the steam injection connection outlet downstream of an intermediate pressure feedwater heater.

20. The method of claim 16, further comprising:

connecting the steam injection connection inlet proximate a low-pressure turbine; and connecting the steam injection connection outlet downstream of a condenser and upstream of one of a high-pressure feedwater heater and an intermediate pressure feedwater heater.

21. The method of claim 16, further comprising:

adding a first steam injection connection having an inlet proximate a high-pressure turbine and an outlet downstream of a feedwater heater; and adding a second steam injection connection having an inlet proximate a low-pressure turbine and an outlet downstream of a condenser and upstream of one of a high-pressure feedwater heater and an intermediate pressure feedwater heater.

* * * * *